US010233042B1

(12) United States Patent
Slattery et al.

(10) Patent No.: US 10,233,042 B1
(45) Date of Patent: Mar. 19, 2019

(54) TOP VACUUM CORRUGATION FEEDER WITH ADJUSTABLE FLUFFER NOZZLES FOR ENHANCED FEEDING OF SPECIALTY SHEETS

(71) Applicant: XEROX CORPORATION, Norwalk, CT (US)

(72) Inventors: Timothy D Slattery, Elma, NY (US); Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/876,643

(22) Filed: Jan. 22, 2018

(51) Int. Cl.

| | |
|---|---|
| ***B65H 3/14*** | (2006.01) |
| ***B65H 5/22*** | (2006.01) |
| ***B65H 3/12*** | (2006.01) |
| ***B65H 3/48*** | (2006.01) |

(52) U.S. Cl.
CPC ..... *B65H 3/14* (2013.01); *B65H 3/128* (2013.01); *B65H 3/48* (2013.01); *B65H 5/222* (2013.01)

(58) Field of Classification Search
CPC ..... B65H 1/124; B65H 1/128; B65H 3/14; B65H 3/48; B65H 5/222
USPC ..... 271/97, 98
See application file for complete search history.

(56) References Cited

U.S. PATENT DOCUMENTS

| | | | | | |
|---|---|---|---|---|---|
| 4,627,605 | A | | 12/1986 | Roller et al. | |
| 4,635,921 | A | | 1/1987 | Thomas | |
| 4,678,176 | A | | 7/1987 | Roller | |
| 4,887,805 | A | | 12/1989 | Herbert et al. | |
| 5,090,676 | A | * | 2/1992 | Matsuno | B65H 3/12 271/111 |
| 5,110,110 | A | * | 5/1992 | Wirz | B65H 3/48 239/587.1 |
| 5,344,135 | A | * | 9/1994 | Isobe | B65H 29/46 271/180 |
| 5,454,556 | A | * | 10/1995 | Siegel | B65H 3/126 271/98 |
| 8,276,905 | B2 | * | 10/2012 | Suzuki | B65H 1/14 271/104 |
| 8,870,179 | B2 | * | 10/2014 | Shiraishi | B65H 1/14 271/104 |
| 2010/0148419 | A1 | * | 6/2010 | Suzuki | B65H 3/128 271/3.11 |

* cited by examiner

*Primary Examiner* — David H Bollinger

(57) ABSTRACT

Both the inboard and outboard fluffer nozzles of a top vacuum corrugation feeder are configured to allow adjustability in angle of air flow. This is to allow the direction of the air to be angled more towards the lead edge or trail edge of a top few sheets in a stack of specialty sheets. The fluffer nozzles are also adjustable in a horizontal plane for positioning at desired locations along the sheet stack. This allows the air to overcome barriers created by the design of specialty media that would otherwise trap the air and prevent it from being distributed between sheets. The cross-section of the nozzles is also adjustable, providing a smaller or wider throat in order to allow the air velocity to be optimized to best separate the sheets in problem areas.

19 Claims, 7 Drawing Sheets

TOP VACUUM CORRUGATION FEEDER WITH ADJUSTABLE FLUFFER NOZZLES FOR ENHANCED FEEDING OF SPECIALTY SHEETS

BACKGROUND

1. Field of the Disclosure

This disclosure relates to an apparatus and method that optimizes media separation from a feed tray of a feeder module.

2. Description of Related Art

As used herein, the term "printers" will be understood to broadly include copiers, printers, multifunction devices, etc., with xerographic, inkjet, or other print media printing systems. The term "sheet" as used herein refers to various print media sheets, of various sized and weights, typically relatively thin, flexible or even flimsy paper and sometimes even plastic.

By way of background, current high speed xerographic copy reproduction machines produce copies at a rate in excess of several thousand copies per hour, therefore, the need for a sheet feeder to feed cut copy sheets to the machine in a rapid, dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable mis-feeds or sheet multi-feeds. It is in the initial separation of the individual sheet from the sheet stack where the greatest number of problems occur.

One of the sheet feeders best known for high speed operation is the top vacuum corrugation feeder with a front air knife, and example of which is shown in U.S. Pat. No. 4,627,605. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the rest of the stack. In operation, air is injected by the air knife toward the stack to separate the top sheet, the vacuum pulls the separated sheet up and acquires it. Following acquisition, a belt transport drives the sheet forward off the stack of sheets. In this configuration, separation of the next sheet cannot take place until the top sheet has cleared the stack. In this type of feeding system every operation takes place in succession or serially, and therefore, the feeding of subsequent sheets cannot be started until the feeding of the previous sheet has been completed. In addition, the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a single or double feeding of sheets. At the appropriate time, during the feed cycle, a valve is actuated establishing flow and hence a negative pressure field over the stack top. This field causes the movement of the top sheet to the vacuum feed head where the sheet is then transported to takeaway rolls. Once the lead edge of the feed sheet is under control of the takeaway rolls, the vacuum is shut off. The trail edge of this sheet exiting the feed head area is the criteria for again activating the vacuum valve for the next feeding.

If however, the lead edge of the fed sheet does not separate from the second sheet, it will cause either a mis-feed or multi-feed, shutting down the machine. It has been found that pre-separating sheets from on another ("fluffing") in a stack is essential in the obtainment of suitable feeding reliability for high volume feeders. This can be more of an issue with specialty stocks, such as, perforated media, media with varying thicknesses, multi-layered media, heavy weight media, etc. as the stocks may have features that prevent the air from flowing between the sheets and/or may require increased air velocity to separate the sheets. Attempts at solving this problem are included in U.S. Pat. Nos. 4,635,921; 4,678,176 and 4,887,805 that variously include fixed front stack fluffer nozzles, vectored auxiliary fluffer nozzles and side stack fluffer nozzles to assist in air knife separation of, for example, severely down curled sheets, etc.

Even with the devices shown in the heretofore-mentioned patents, there is still a need for an improved top vacuum corrugation feeder that can reliably control feeding of specialty media within a printer apparatus.

BRIEF SUMMARY OF THE DISCLOSURE

Accordingly, in answer to the above-mentioned problem, disclosed herein is an improved top vacuum corrugation feeder that includes inboard and outboard fluffer nozzles that are configured with added adjustability in order to allow the direction of air exiting therefrom to be angled toward the lead edge or trail edge of a top few sheets of a sheet stack. This allows the air to overcome barriers created by the design of specialty media that would otherwise trap the air and prevent it from being distributed between sheets. The cross-section of each nozzle is also adjustable, providing a smaller or wider throat which allow the air velocity to be optimized to best separate the sheets in problem areas. In addition, the nozzles are also adjustable along a horizontal plane for positioning the nozzles at desired location along the sheet stack.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

While the present disclosure will hereinafter be described in connection with a preferred embodiment, it will be understood that it is not intended to limit the disclosure to that embodiment. On the contrary, it is intended to cover all alternatives, modifications and equivalents as may be included within the spirit and scope of the disclosure as defined by the appended claims.

Figure 1:
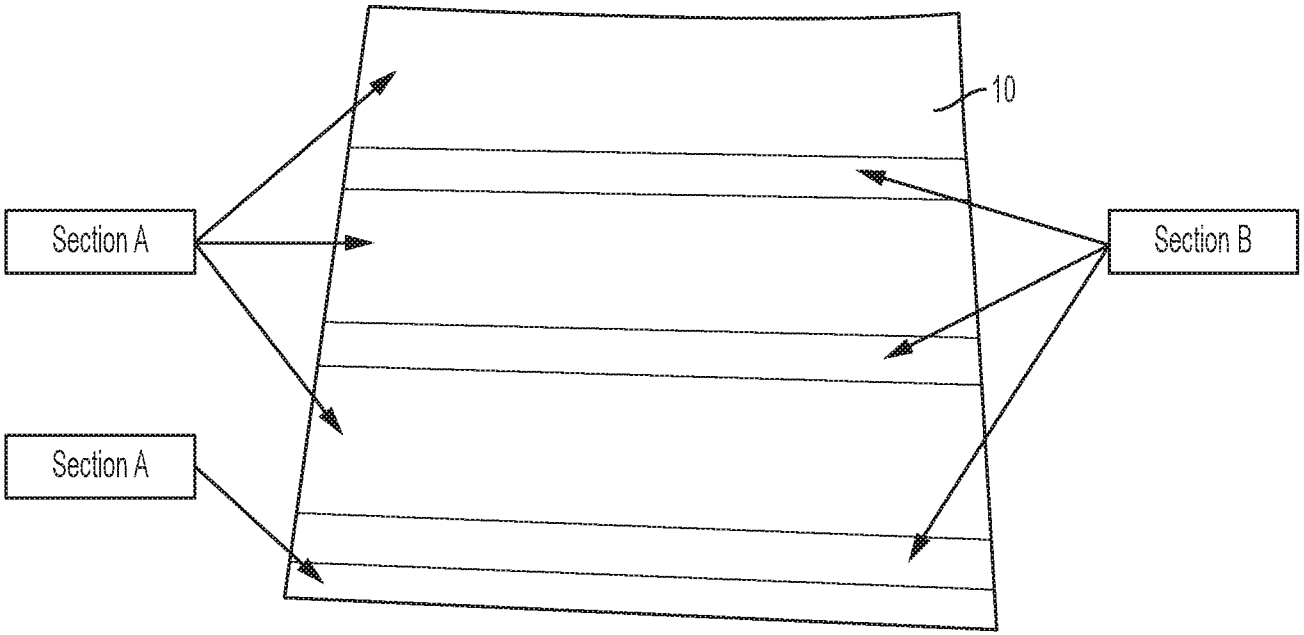
FIG. 1 is a partial, top view of media that is difficult to feed with a top vacuum corrugation feeder.

Even with the improvements in the above-mention patents, with certain media, it is very difficult for fluffer nozzles working in conjunction with a vacuum corrugation feeder to separate the lead edge of stacked sheets. If the lead edge is not separated, two sheets can be acquired by the feed head. The air knife will be unable to separate them and a multi-sheet feed will result. This can be exacerbated when the media has features such as perforations, varying thickness, multiple layers, heavy weight, etc. One example of difficult to feed media 10 is shown in FIG. 1 which includes sections A and B. Section A is comprised of three layers: a backer sheet (bottom layer), an adhesive backed Mylar® (middle layer), and a coated top sheet. The top layer is removed in three sections indicated as section B. This not only creates variable thickness where section B is 0.002" thinner than section A, but also creates an effective hinge between the sections.

Figure 2:
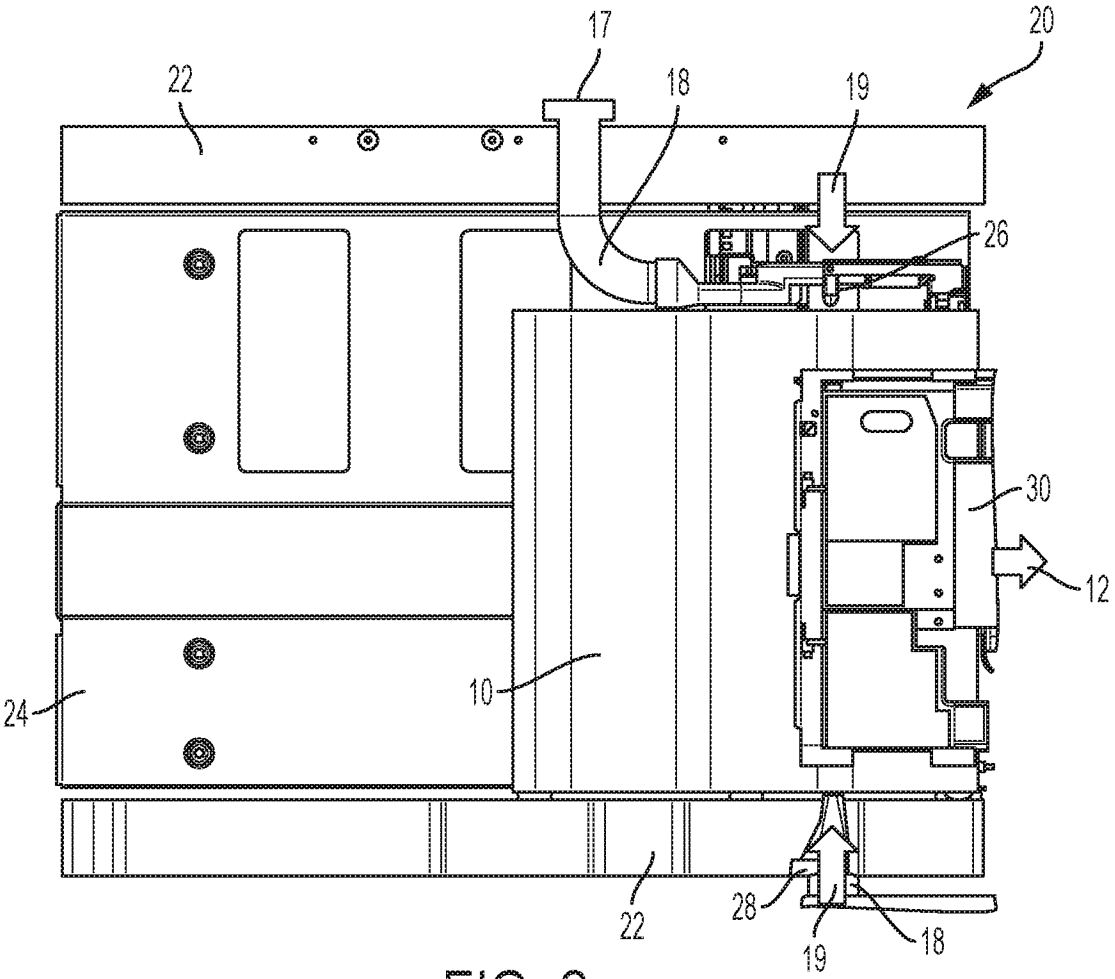
FIG. 2 is a partial, top view of a prior art top vacuum corrugation feeder showing air flow from standard fluffer nozzles.
Figure 3A:
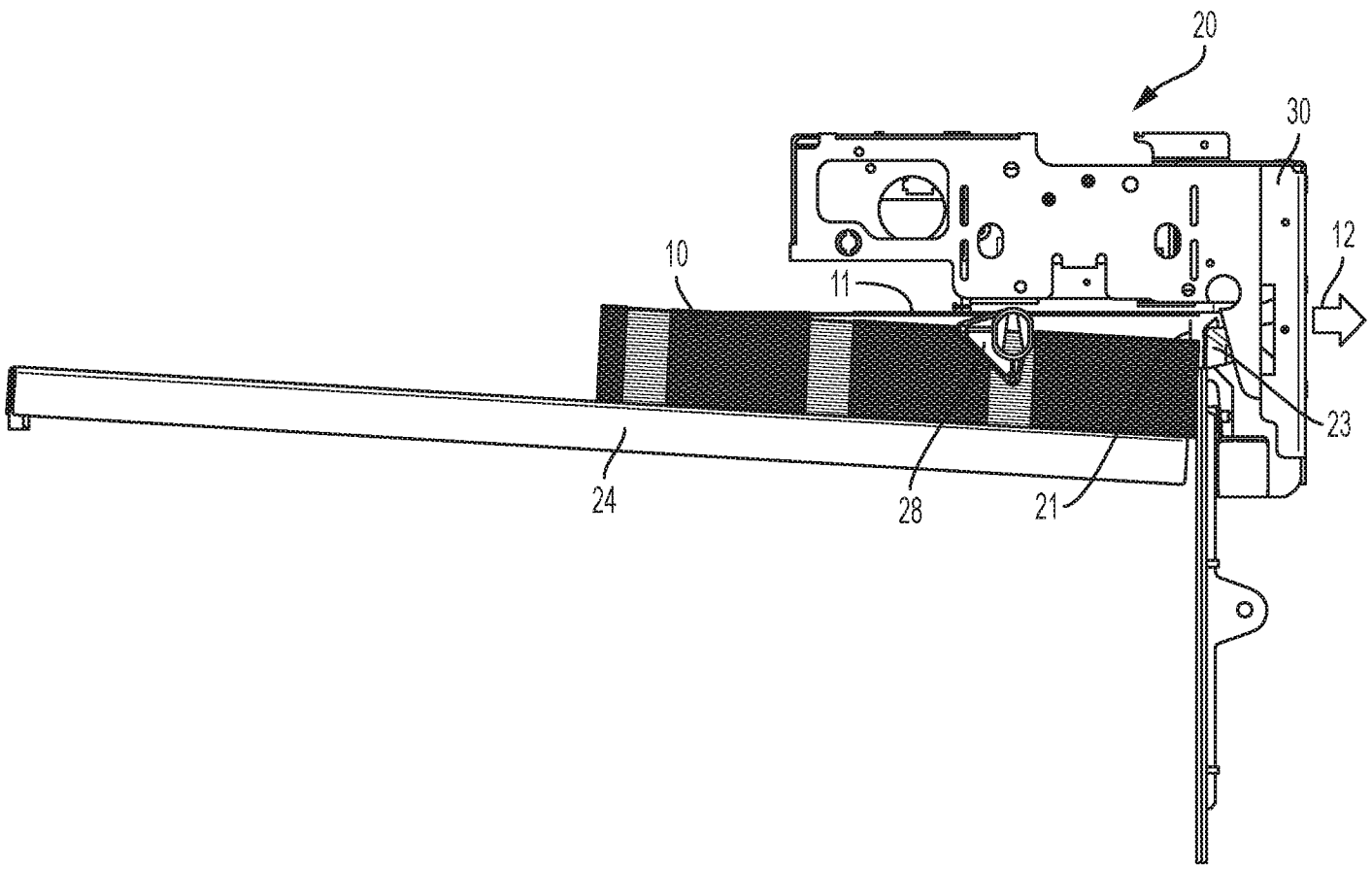
FIGS. 3A and 3B are enlarged, partial side views of the top vacuum corrugation feeder of FIG. 2 showing fluffing performance of a stack of FIG. 1 media.
Figure 3B:
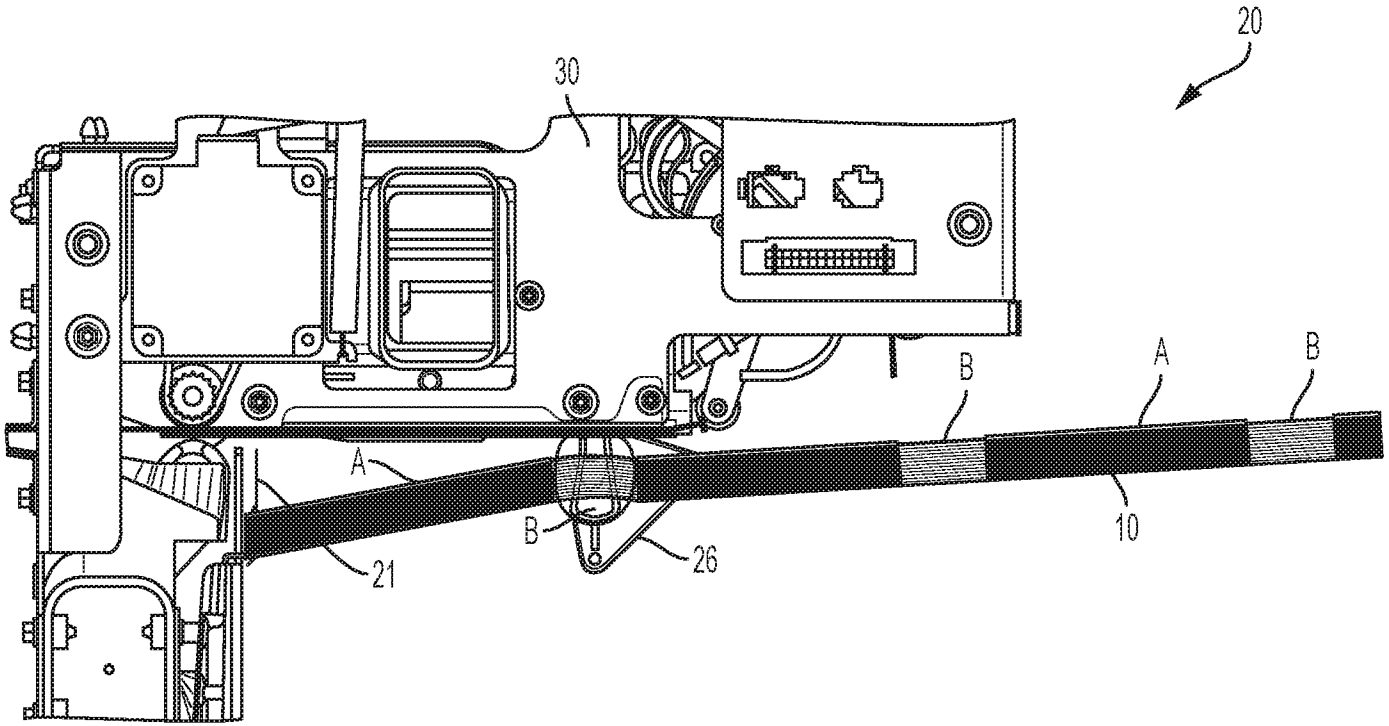

Frequently blower speed is increased to create better fluffing performance with specialty stocks. The downside of this approach is that the air system is run off of one blower. Therefore, if the fluffer air velocity is increased, so is the vacuum and air knife air velocity. This can have adverse results such as over corrugation of the sheet, stubbing into a retard plate, and premature wear due to increased forces. FIG. 2 shows a top view of the media 10 of FIG. 1 loaded into a conventional vacuum corrugation feeder 20. The media 10 is loaded into a tray 22 onto a media support surface 24 with media 10 being positioned for feeding under feed head 30 in the direction of arrow 12. Inboard and outboard fluffer nozzles 26 and 28, respectively, are positioned orthogonal with respect to media 10 and are located such that they blow air directly through the thin section (section B) of the media. A blower 17 supplies air through tubing 18 in the direction of arrows 19 to nozzles 26 and 28. As shown in FIG. 3A, vacuum corrugation feeder 20 includes a retard plate 21 to assist air knife 23 in media separation. Prior to feeding the first sheet 11 of media 10, the air system is turned ON. The inboard and outboard fluffer nozzles 26 and 28 in FIG. 2 continuously blow air orthogonally into the side of the top sheets in the stack. This forces the sheets to rise towards the feed head. To feed a sheet, the vacuum in the feed head 30 is turned ON, acquiring the first sheet 11. Afterwards, air knife 23 is turned ON and the subsequent sheets are blown down away from the feed head. The feed head then moves the sheet forward, taking the sheet to an exit in the direction of arrow 12. When feeding specialty media 10, the air is unable to escape from section B to the lead edge of media and the media arcs, forcing the lead edge down away from feed head 30 as shown by the fluffing behavior of this stock in FIG. 3B.

Figure 4A:
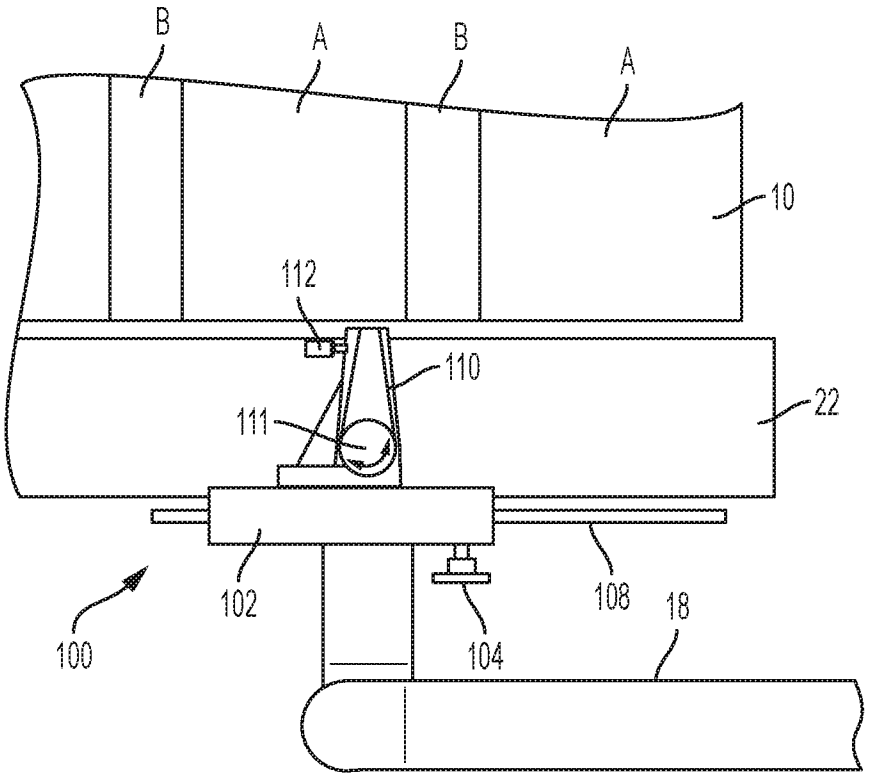
FIGS. 4A and 4B are enlarged, partial top views of adjustable fluffer nozzle configurations.
Figure 4B:
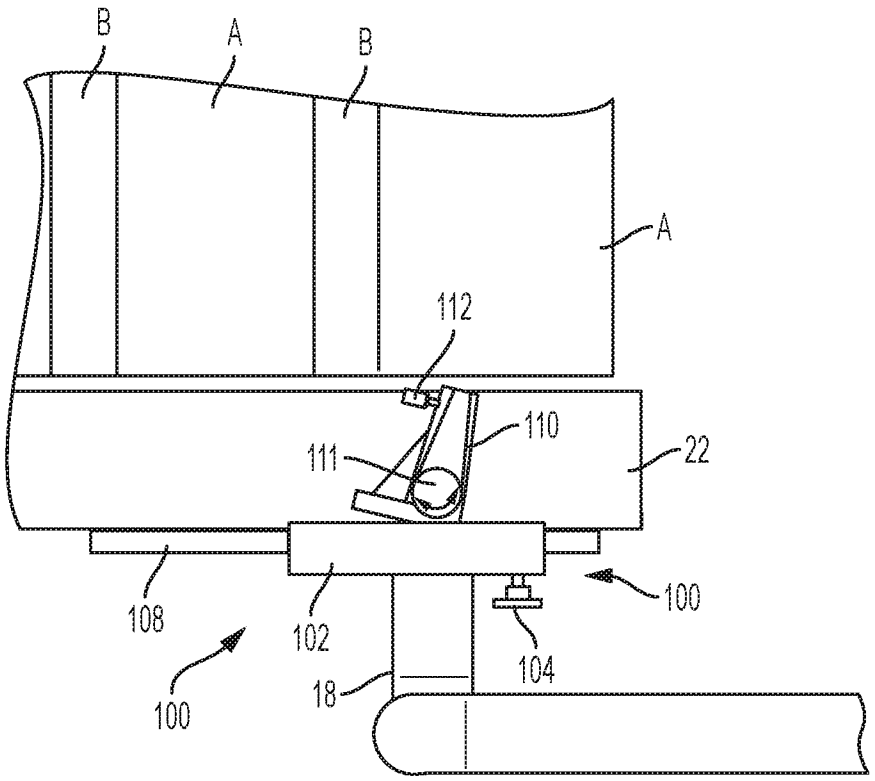

In accordance with the present disclosure, improved adjustable fluffer nozzle arrangements 100 are shown in FIGS. 4A and 4B with angles of adjustable nozzles 110 being configurable in predetermined increments to force air past section B of media 10, as well as, being translatable in a horizontal plane to multiple positions along a length of media 10 where needed to thereby provide more than sufficient lead edge separation of media 10 while simultaneously greatly decreasing the shutdown rate of top vacuum corrugation feeder 20. Translation of the nozzles 110 is accomplished by rotating knob 104 in order to loosen the attachment of slide member 102 to support rod 108 and moving slide member 102 to a location as dictated by the makeup of the media being fed. Flow direction of nozzles 110 is adjusted by use of knob 111. That is, the direction of the air exiting nozzles 110 can be angled more towards either the lead edge or trail edge of the sheet by rotating knob 111. This allows the air to overcome barriers created by the design of specialty media that would otherwise trap the air and prevent it from being distributed between sheets of media. The cross-section of nozzles 110 is also adjustable through rotation of knob mechanism 112 connected to vanes (not shown) within each nozzle. Knob mechanism 112 repositions the vanes within each nozzle thereby providing a smaller or wider nozzle throat. This allows the air velocity to be optimized to best separate sheets of media in problem areas.

For testing, as partially shown in FIG. 4B, inboard and outboard fluffer nozzles 110, were pivoted to an angle of 15° toward the lead edge of media 10. The angle of the nozzles forced the air past section B of media 10 and provided necessary lead edge sheet separation while greatly decreasing the vacuum feeder shutdown rate. While nozzle angles of 15° were used for testing purposes, it should be understood that angle and throat adjustment of the nozzles would be dependent upon requirements for feeding particular specialty media with a top vacuum corrugation feeder.

Figure 5B:
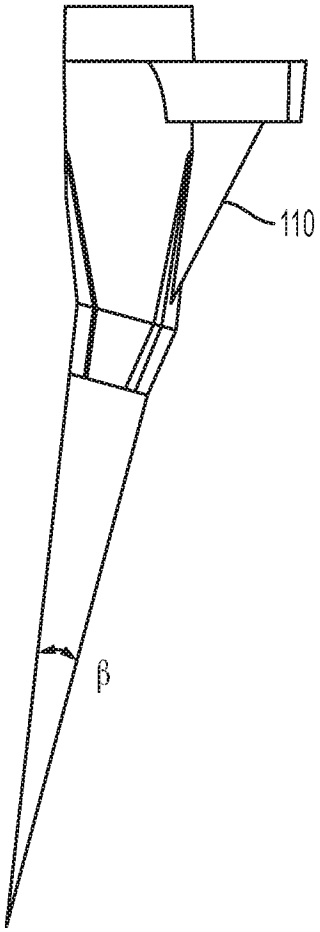
FIG. 5B is a partial, schematic top view of the adjustable fluffer nozzle of FIG. 4A with β representing the velocity of air from the nozzle.
Figure 5A:
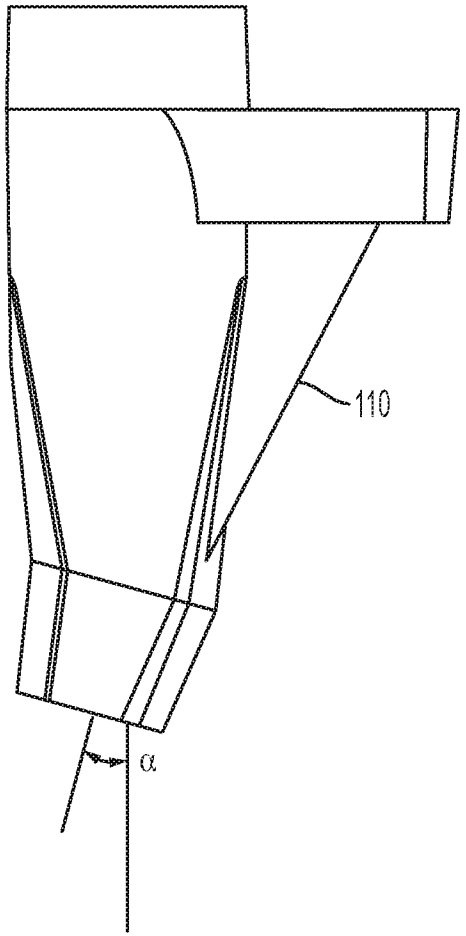
FIG. 5A is a partial, schematic top view of the adjustable fluffer nozzle of FIG. 4A where a is the angle of the direction of fluff.

In FIGS. 5A and 5B, two degrees of adjustability are shown where in FIG. 5A, a is the angle of the direction of the fluff with a higher angle pointing the flow more towards the lead edge of media and in FIG. 5B, β controls the velocity of the air with a lower angle creating a more narrow throat and a higher velocity. With these two degrees of adjustability built into fluffer nozzles 110, their behavior can be tuned to properly fluff a wider variety of stocks.

In recapitulation, an apparatus is disclosed that adds three adjustment parameters to the design of the inboard and outboard fluffers within a top vacuum corrugation feeder. One adjustment is the angle of the flow centerline with respect to the normal of the stack face. The second is the taper angle of the fluffer which determines the convergence point and velocity of the flow. And third is the ability to translate the fluffers in a horizontal plane with respect to a top few sheets of a sheet stack in order to position the nozzle in accordance with requirements of particular specialty media. Moreover, angled air fluffers expand media stack fluffing capability by introducing a process direction vector in addition to the normal cross process pattern. It has been found that proper selection of these three parameters allows reliable fluffing and feeding of several non-standard media types including multi-layered label stock. While an embodiment has been shown that facilitates manual adjustment of these parameters, it is contemplated that nozzle adjustment parameters could also be accomplished with automation, if desired. In addition, preset blower configurations could also be enabled for specific applications and adjustable angle and flow rate of the nozzles could be based upon timed exit sensing.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A top sheet separator feeder for separating and forwarding sheets seriatim from the top of a stack of sheets, comprising:

a stack tray for supporting a stack of sheets to be fed;

a vacuum feed head extending over at least the front end of the sheet stack tray for acquiring and advancing the top sheet of the stack by applying a negative pressure thereto;

an air knife positioned in front of the stack tray for applying air pressure to the sheets in the stack tray to separate the top sheet from the next adjacent sheet; and non-flexible and air flow adjustable fluffer nozzles positioned on opposite sides of said sheet stack to assist in separating the top sheet from the next adjacent sheet, and wherein adjustment of said non-flexible and air flow fluffer nozzles causes air expelled therefrom to converge at a predetermined downstream point to thereby allow the velocity of air expelled from said non-flexible and air flow adjustable fluffer nozzles to be optimized to best separate said top sheets in problem areas.

2. The top sheet separator feeder of claim 1, wherein said non-flexible and air flow adjustable fluffer nozzles are translatable in a horizontal plane.

3. The top sheet separator feeder of claim 2, wherein said non-flexible and air flow adjustable fluffer nozzles are rotatable in said horizontal plane.

4. The top sheet separator feeder of claim 3, wherein air flow velocity of said non-flexible and air flow adjustable fluffer nozzles is adjustable.

5. The top sheet separator feeder of claim 2, wherein said non-flexible and air flow adjustable fluffer nozzles are connected to a slide mechanism.

6. The top sheet separator feeder of claim 5, wherein said slide mechanism is mounted on a rod member.

7. The top sheet separator feeder of claim 6, wherein said non-flexible and air flow adjustable nozzles are connected to an air plenum.

8. A top vacuum corrugation feeder apparatus, comprising:

a sheet stack support tray;

a feed head assembly including a vacuum chamber positioned over the front of a stack of sheets when sheets are placed in the tray with the vacuum chamber having a negative pressure applied thereto at all times during a feed cycle, said vacuum chamber having a sheet corrugation member mounted in about the center of its bottom surface and perforated belts associated with said vacuum chamber to transport the sheet acquired by said vacuum chamber in a forward direction out of the stack support tray;

an air knife positioned immediately adjacent the front of said stack of sheets for applying a positive pressure to the sheet stack in order to separate the uppermost sheet from the rest of the stack;

non-flexible fluffer nozzles positioned on opposite sides of the sheet stack and configured to assist said air knife in separating the uppermost sheet in the stack from the rest of the stack, said non-flexible fluffer nozzles being pivotable in a horizontal plane into one of a plurality of angles to allow air from said fluffer nozzles to overcome barriers to sheet separation on an upper surface of said sheets, and wherein each of said non-flexible nozzles includes an arrangement that adjusts taper angles of said non-flexible fluffer nozzles in order to determine a convergence point and velocity of air flowing from said non-flexible fluffer nozzles in order to separate a wide variety of said sheets from a stack positioned on said sheet stack support tray.

9. The top vacuum corrugation feeder apparatus of claim 8, including adjustment members for controlling pivoting of said fluffer nozzles.

10. The top vacuum corrugation feeder apparatus of claim 9, wherein said adjustment members include rod mounted slide members adapted for translating said non-flexible fluffer nozzles within said horizontal plane.

11. The top vacuum corrugation feeder apparatus of claim 8, wherein pivoting of said non-flexible fluffer nozzles changes the angle of a flow centerline of said non-flexible fluffer nozzles with respect to the normal of the face of said sheet stack.

12. The vacuum corrugation feeder apparatus of claim 11, wherein said non-flexible fluffer nozzles are translatable in a horizontal plane with respect to a top few sheets of said stack of sheet in order to position said non-flexible fluffer nozzles as needed.

13. A top sheet feeding apparatus especially for feeding specialty sheets, comprising:

a sheet stack support tray;

a feed head including a vacuum plenum chamber positioned over the front of a stack of sheets when sheets are placed into said sheet stack support tray with said vacuum plenum chamber having a negative pressure applied thereto at all times during a feed cycle, said vacuum plenum chamber having a sheet corrugation member mounted in the center of its bottom surface and perforations in the center of its bottom surface and perforated feed belts associated with said vacuum plenum chamber to transport the sheet acquired by said vacuum plenum chamber in a forward direction out of said sheet stack support tray;

an air knife positioned immediately adjacent the front of sheets stacked in said sheet stack support tray for applying a positive pressure to the sheet stack in order to separate the uppermost sheet from the rest of the stack; and at least one air flow adjustable, non-flexible fluffer nozzle positioned on opposite sides of sheets stacked in said sheet stack support tray and adapted to assist said air knife in separating said uppermost sheet from the rest of the stack.

14. The top sheet feeding apparatus of claim 13, wherein said at least one air flow adjustable, non-flexible fluffer nozzle positioned on opposite sides of sheets stacked in said sheet stack support tray is pivotable within a horizontal plane.

15. The top sheet feeding apparatus of claim 14, wherein said at least one air flow adjustable, non-flexible fluffer nozzle positioned on opposite sides of sheets stacked in said sheet stack support tray is translatable adjacent said sheets stacked in said sheet stack support tray.

16. The top sheet feeding apparatus of claim 15, wherein a cross-section of a throat portion of said at least one air flow adjustable, non-flexible nozzle positioned on opposite sides of sheets stacked in said sheet stack support tray is configurable in order to allow velocity of air flowing from said at least one air flow adjustable, non-flexible nozzle to be optimized for different specialty sheets.

17. The top sheet feeding apparatus of claim 16, wherein said at least one air flow adjustable, non-flexible nozzle positioned on opposite sides of sheets stacked in said sheet stack support tray is attached to a slide mechanism.

18. The top sheet feeding apparatus of claim 17, wherein said slide mechanism is mounted on a rod member.

19. The top sheet feeding apparatus of claim 13, wherein said at least one air flow adjustable, non-flexible fluffer nozzle positioned on opposite sides of sheets stacked in said sheet stack support tray is rotatable within a horizontal plane.

* * * * *